US008839827B2

(12) United States Patent
Heatley

(10) Patent No.: US 8,839,827 B2
(45) Date of Patent: Sep. 23, 2014

(54) AEROSOL CONTAINER FILLING SYSTEM

(75) Inventor: Christopher Heatley, McHenry, IL (US)

(73) Assignee: Seymour of Sycamore, Inc., Sycamore, IL (US)

( * ) Notice: Subject to any disclaimer, the term of this patent is extended or adjusted under 35 U.S.C. 154(b) by 905 days.

(21) Appl. No.: 12/961,982

(22) Filed: Dec. 7, 2010

(65) Prior Publication Data

US 2012/0138188 A1 Jun. 7, 2012

(51) Int. Cl.
*B65B 29/00* (2006.01)
*B65B 31/00* (2006.01)

(52) U.S. Cl.
CPC ..... *B65B 31/003* (2013.01)
USPC ..... 141/20.5; 141/21; 141/378; 141/104

(58) Field of Classification Search
USPC ..... 141/20, 20.5, 21, 25, 27, 284, 100, 104, 141/372, 378
See application file for complete search history.

(56) References Cited

U.S. PATENT DOCUMENTS

| | | | | |
|---|---|---|---|---|
| 3,338,022 | A * | 8/1967 | Moonan et al. | 141/20 |
| 3,444,906 | A * | 5/1969 | Moonan et al. | 141/20 |
| 4,938,260 | A | 7/1990 | Hirz | |
| 5,377,724 | A * | 1/1995 | Ray | 141/20 |
| D361,581 | S | 8/1995 | Hirz | |
| 5,535,790 | A | 7/1996 | Hirz | |
| 5,647,408 | A | 7/1997 | Erste et al. | |
| 5,740,841 | A | 4/1998 | Hirz | |
| 5,832,965 | A * | 11/1998 | Fasse et al. | 141/20 |
| 6,135,165 | A | 10/2000 | Zanellato et al. | |
| 6,138,720 | A | 10/2000 | Zeigler | |
| 6,302,163 | B1 | 10/2001 | Zeigler | |
| 6,705,359 | B1 | 3/2004 | Zanellato et al. | |

FOREIGN PATENT DOCUMENTS

| | | |
|---|---|---|
| DE | 202009007410 U1 | 10/2009 |
| EP | 2062821 | 5/2009 |
| GB | 1103083 | 2/1968 |
| WO | 2007/113561 | 10/2007 |

OTHER PUBLICATIONS

International Search Report and Written Opinion for PCT/US2011/041618, completed Sep. 27, 2011.
Invitation to Pay Additional Fees document for International App. No. PCT/US2011/041618, mailed Oct. 5, 2011.
CleanJector Disposable Paint Cylinder, Motip Dupli Group, website <http://www.motipdupli.de/index.php? id=ipg_1246&L=2> printed on Dec. 7, 2010.
VitoMat III Pneumatic Filling Machine, Motip Dupli Group, website <http://www.motipdupli.de/index.php? id=ipg_1236&L=2> printed on Dec. 7, 2010.

* cited by examiner

*Primary Examiner* — Jason K Niesz
(74) *Attorney, Agent, or Firm* — McDonnell Boehnen Hulbert & Berghoff LLP

(57) ABSTRACT

A system for charging pressurized aerosol cans with liquid is provided combining a disposable syringe and filling machine. The syringe is loaded with a liquid, then placed in the filling machine and connected to the inlet of the pressurized container. The filling machine is activated and an electric motor or a hydraulic piston exerts force on the syringe to inject the liquid into the aerosol container.

10 Claims, 2 Drawing Sheets

AEROSOL CONTAINER FILLING SYSTEM

BACKGROUND

My invention relates to a device and system to allow for the preparation of a pressurized container of paint formulation of a desired color and gloss at the point of retail sale to the ultimate end user. Specifically, my invention relates to a system for injecting a paint composition into pressurized containers, and, more particularly, to an improved filling system for filling aerosol cans that uses a syringe assembly to measure and hold a desired paint formulation and to inject it into the pressurized container.

One of the most significant developments in the field of paints and other protective coatings is the introduction and development of aerosolized coatings, most commonly referred to as "spray paint." Retail stores have shelf upon shelf of these pre-filled pressurized containers of complete paint and coatings formulations, in every imaginable color and gloss that are "ready to use". These complete, pre-packaged spray paint containers provide the customer with a convenient means to purchase small quantities of paint in a readily useable spray container for easy application. Unfortunately, in situations where the end user has a particular color in mind or wants to match a particular existing color, the current art of spray paint forces the end user to select a paint color that in most cases is not the exact color that the user desires. This is because there is no convenient means to allow a consumer to select a color and have that exact color made at the point of purchase. Instead, the user must search a myriad of brands of spray paint in the hope of finding a color that at least comes close to the desired color. Often times, this causes the end user to travel from store to store in search of such a match. Another drawback of the conventional spray paint product is that the inability to prepare a final paint color at the point of sale directly affects the retailer. Because conventional spray paint is only available from the manufacturer in pre-selected and predetermined colors and gloss, the retailer is forced to stock and carry inventory for a large number of cans to accommodate a large number of colors and gloss finishes. This further requires the use of an inordinate amount of shelf space in the store, thus limiting the amount of other products that can be displayed.

A convenient solution to the above mentioned problems would be to allow the retail outlet at the point of sale to formulate the final color of the spray paint based on the end user's selections of color and gloss at the moment of sale. In this way only a very limited number of spray containers containing either a clear or neutral base paint formulation need to be stocked and shelved by the retailer. The end user can then select a final paint formulation that exactly matches his or her needs. Of course, once the final color is selected, there exists the problem of injecting the final paint formulation into the can. In a manufacturing setting large, non-portable paint filling machines are routinely used to inject paint formulations into pre-pressurized containers. However, at the retail level, such machines are non-existent or very rare. Existing paint filling machines are presently available as large bench mounted machines that are pneumatically operated to inject paint and the like into pre-charged aerosol cans. Some examples of these machines are described in U.S. Pat. Nos. 6,302,163 and 6,138,720 and in the references cited in those two patents. Likewise, U.S. Pat. Nos. 5,740,841; 5,647,408, Des. 361,581; 4,938,260, and 5,535,790, each describe various filing machine designs that can inject a complete "custom" paint formulation into a pressurized can. Such machines commonly include a large manually operated lever that is connected to a piston assembly that pneumatically injects a paint formulation from a reservoir through the aerosol valve and into the can. One drawback of these existing machines is that the clean up of the various components after an injection is tedious and time consuming.

Despite the improvements the art has seen in the design of paint filling machines, the art has not concerned itself with size, portability, or the need to efficiently prepare many final paint formulations at a retail store location in a short period of time. Although my earlier issued U.S. Pat. Nos. 6,705,359 and 6,135,165 describe a pressurized container containing certain paint additives that is eventually filled with a final water-borne paint composition of a selected color at the point of sale, those patents do not describe in detail any particular type of paint filling system that can be easily used at the point of sale location. My present invention now provides a new and improved compact aerosol can filling apparatus that includes a disposable syringe assembly that eliminates the need to clean the filling machine after each use.

SUMMARY

My invention includes a system for injecting paint formulations and the like materials into a pre-pressurized container or can at a point of sale at the retail level. The system of my invention comprises, in combination, a housing comprising a drive mechanism and an adjustable platform, where the housing is self-supporting and sized to easily fit on a counter of a retail store, such as a hardware store or paint store. Attached to the drive mechanism is a drive shaft. The system further includes a rigid cup that is operatively located within the housing and is preferably removable from the housing to allow a syringe assembly to be inserted within the cup. The syringe assembly has two uses. The first allows the user to accurately measure and withdraw a paint formulation from an eternal container or other source that will be injected into a pressurized container containing an initial paint formulation. The second use of the syringe is to deliver or inject, with the assistance of the drive shaft, the paint formulation contained within the syringe barrel into the pressurized container to prepare the final pressured spray paint product. Although my invention is described herein as preparing pressurized spray paint containers at the point of sale, my system can be used to prepare any pressurized spray container containing liquids other than paint, for example, air fresheners, cleaners, polishes, insecticides, repellants, lubricants, and like pressurized spray products sold to consumers at retail stores. For clarity and ease of understanding the following description will relate to preparing a spray paint container.

The syringe assembly of my system is preferably disposable and manufactured using biodegradable materials. The syringe has a distal end and a proximal end. Unlike a medical syringe, the syringe of my invention does not use a sharp metal needle cannula, however, it may have a distal end that tapers to a smaller diameter opening than the opening at proximal end, which is configured to accept a plunger having a piston configured to slidably and sealably fit within the syringe barrel. The distal end of the syringe barrel may have a tube or other small diameter extension that allows the syringe to more accurately withdraw a paint formulation or other liquid from an external container or receptacle. At the proximal end of the syringe is an opening to the syringe barrel that is larger in diameter than the distal end. A plunger is inserted in the proximal end and is preferably made from the same biodegradable materials as the syringe barrel so that when used the entire syringe assembly can be safety and easily disposed. Filling of the syringe barrel can be perform by adding a paint formulation or the individual ingredients making up a paint formulation into the proximal end opening of the barrel as opposed to withdrawing liquids through the more narrow opening distal end of the barrel. Most preferably the syringe assembly would be made using a clear or opaque plastic, preferably recycle plastic, such that the user could easily see the liquid level and plunger position within the syringe barrel.

In one possible use of my invention, a new and unused syringe is used for each preparation of a final spray container sold at a retail location. For example, first a customer selects his desired end product color from a color chart or by matching an existing color from a sample. Next, the retail store employee determines a recipe for a paint formulation (or other liquid formation if the end product is not a spray paint product) that when injected into a pressurized can containing an initial paint formulation (or other initial formulation) will result in a spray paint product that matches the color and gloss requested by the customer. The employee then uses a new clean syringe assembly to withdraw (i.e., suck up) the paint formulation (or in some cases each of the individual components that will make up the paint formulation) from an external container(s). Graduation marks on the side of the syringe barrel allow the user to accurately withdraw the liquid(s) into the syringe barrel. In some circumstances an automated filling machine may be used to add a paint formulation to the syringe barrel. A preferred configuration of the syringe assembly would include a cap that can cover the proximal end of the syringe to create an airtight seal. This would allow a paint formulation placed in the syringe to be stored for future use. Most preferably the cap is tethered or otherwise connected to the proximal end of the syringe so that it is easily accessible to be connected to the proximal end. The tether can be permanent or removable.

Once the correct amount of paint formulation is loaded into the syringe, the user then transfers the syringe to the rigid cup. This can be done with the cup mounted in the housing or by first removing the cup from the housing. The loaded syringe is placed within the cup such that the distal end of the syringe protrudes through an opening in the bottom (i.e., distal end) of the cup. Preferably the syringe barrel is configured to provide a secure fit within the rigid cup. The cup with the syringe inside is then mounted in the housing of the filling machine such that distal end of the syringe can connect with the valve in top of a pressurized container containing an initial paint formulation. Importantly, the rigid cup is completely isolated from the paint formulation and after each use dose not need to be cleaned.

The connection between the syringe and the pressurized container is preferably accomplished using an adaptor or other fitting that ensures a fluid seal to allow transfer of the liquid in the syringe into the container. This adaptor can be configured to be disposable or reusable. Preferably, the adaptor provides a proprietary connection to the pressurized containers such that no other manufacturer's containers will connect with the adaptor. This prevents the operator of the filling system from using the wrong or improper container in the filling machine. To achieve this keyed connection between the adaptor and the pressurized container, the distal end of the adaptor and the valve opening in the container have matching connectors, such as grooves, slots, splines, thread pitch, bayonet fittings, or the like keyed features that work similar to a key and lock combination.

The user then connects the syringe plunger to the drive shaft, preferably through a bushing or similar connector. The bushing allows the plunger of the syringe to be easily and securely attached to the drive shaft of the drive mechanism, preferably the bushing is a quick-disconnect type of fitting to allow the operator of my system to easily and quickly connect the syringe plunger to the drive shaft. The drive mechanism can be any device capable of driving the plunger towards the distal end of the syringe to cause the liquid contained in the syringe barrel to inject into the pressurized container. For example, a hydraulic drive mechanism that uses a telescopic piston rod or an electric motor that rotates a threaded shaft that moves the drive shaft (and bushing) axially downward in the distal direction or a hand operated crank can be used as the drive mechanism.

The pressurized container that is to be filled using the system of my invention is preferably manufactured and provided to retail outlets as a so-called "blank" (i.e., pre-pressurized cans containing and initial paint formulation but without color). These blank cans can be made available by a manufacture containing a number of different initial liquid formulations that are compatible with the liquid formulation being injected through the syringe. In the case of preparing a finished spray paint product, the pressurized container comprises an initial paint formulation comprising a propellant and at least one of a clear non-pigmented base or clear pigmented base.

Once the pressurized container of initial paint formulation is prepared and provided to the retail outlet, the container is ready for display and sale at the retail level. Immediately prior to the sale, the ultimate end use or customer selects a final color and gloss level to complete the final paint formulation. A recipe or look up table is used by the store employee to determine the exact volumetric or weighed amounts of tints and/or pigment dispersions that are needed to be added to the pressurized container through a filling opening in the pressurized container to achieve the desired final color. These tints and/or pigment dispersions can be added individually or preferably as a single cocktail or formulation. Whether one ingredient or several ingredients are added individually or as a mix, the additives for the purposes of this disclosure are considered a liquid formulation or a paint formulation.

Typically, the final color desired is based on a matching of an existing color or type of paint previously purchased by the user. The end user will select a final color for the aerosol container of our invention by one of several methods. The user may manually reference a color wheel, paint swatches, or paint chips to select a final color and will also select or request a preferred gloss level. For each color that can be selected there will be a corresponding predetermined formula or recipe of tints and/or pigmented dispersions that when followed and the ingredients mixed with one of the three possible initial paint formulations will yield the final desired color.

Alternatively, the user may want to match an existing color based on a sample of a color that they would bring with them to the point of sale. This is performed simply by comparing the known color provided by the user to a color wheel or to paint swatches, or by using a spectrophotometer or other automated system to match colors. Typically, such an automated procedure involves providing a sample of a known color for analysis by a spectrometer whereby the exact sample color is determined and reported to either the end user or the retail store operator or directly to a computer controlled filling machine.

Once the final sample color is determined and a formula of additives is determined, the ingredients according to the formula are mixed together (or added separately) and drawn into the syringe. The syringe is used to inject this formula comprising pigmented dispersions and/or tints to the pressurized container to achieve the desired color of the final paint formulation. Additionally, flattening dispersions may be added to achieve the desired gloss level, which is typically determined using gloss meter, preferably at a 60° angle. Flattening dispersions are added to modify the gloss level to the desired finish. The filling device of my invention has an adjustable platform that can be set to accommodate pressurized containers with sizes of 8 oz., 16 oz., and 20 oz.

Still further advantages of the present invention will become apparent upon reading and understanding the following detailed description of preferred embodiments. The invention also may take form in various parts and arrangement of parts. The accompanying drawings are only for purposes of illustrating preferred embodiments and are not to be construed as limiting the invention.

BRIEF DESCRIPTION OF THE FIGURES

The advantages and features of the present invention will become better understood with reference to the following more detailed description and claims taken in conjunction with the accompanying drawings, in which like elements are identified with like symbols, and in which:

DETAILED DESCRIPTION

Figure 1:
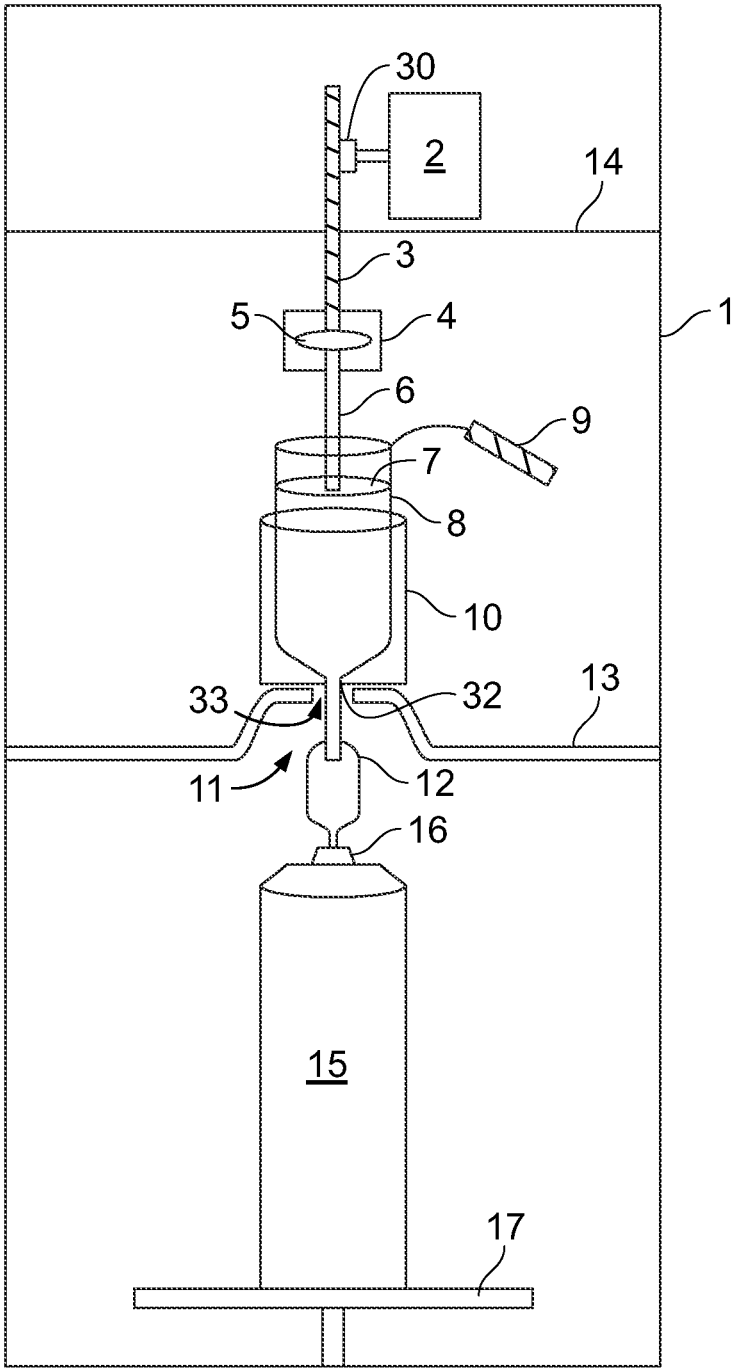
FIG. 1 is a schematic representation of the various components of the filling system of my invention.

Referring now to FIG. 1, which shows a schematic view of one possible embodiment of the container filling system of my invention. The system is preferably contained in housing 1 and is designed to be bench mounted in a retail store. Within the housing is an upper platform 14 that supports a drive mechanism 2 having a drive shaft 3. Drive shaft 3 can be motor or hydraulic driven. As shown in the figure, drive mechanism 2 drives a coupling 30 that is threadedly engaged to drive shaft 3, which is allowed to move axially, but is prevented from rotating by upper platform 14. This can be accomplished through the use of a slot and groove engagement between the platform and the drive shaft. As coupling 30 turns or rotates about the threads on drive shaft 3, the shaft will move up (proximally) or down (distally). A bushing 4 can be used at the distal end of the shaft to engage syringe plunger head 5. The bushing should be configured so that head 5 of plunger 6 can be easily attached to and removed from bushing 4 by the user of my system, preferably without the use of tools, for example through a snap fit-type connection being most preferred. As the drive shaft is caused to move axially downward by the drive mechanism 2, the attached busing 4 also moves downward forcing the syringe plunger 6 to likewise move distally. The drive mechanism must supply enough force to overcome the initial pressure of the container to be filled by the paint formulation contained with the syringe barrel.

Figure 2:
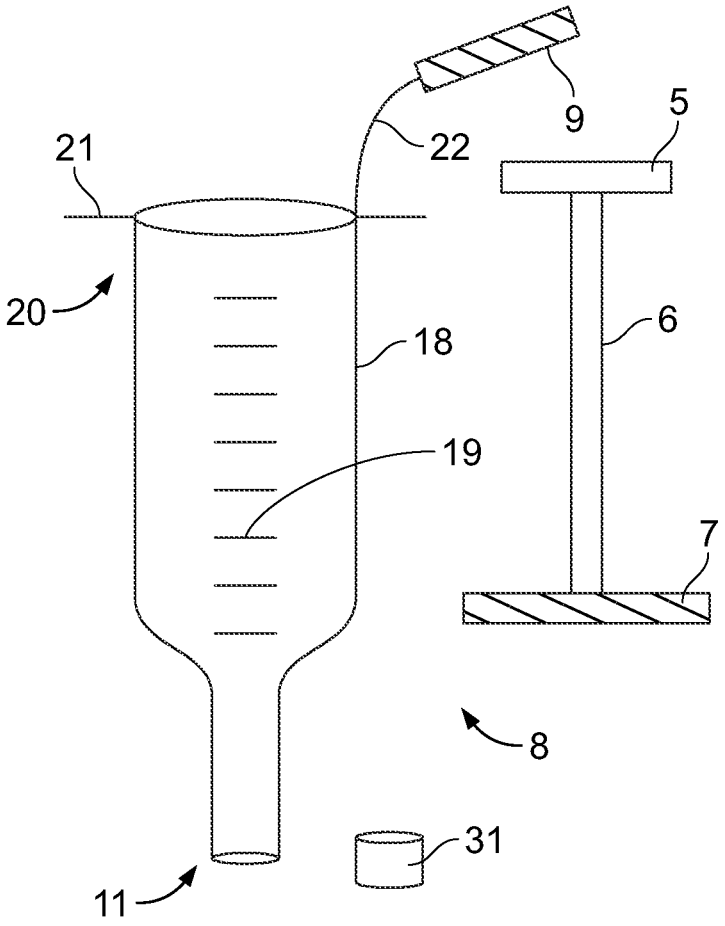
FIG. 2 is an exploded view of the syringe assembly used in my invention.

The syringe assembly 8 is comprised of several components as best illustrated in FIG. 2. There is a removable plunger 6 that has a piston 7 attached at the distal end. This piston can be configured to be removable from the plunger. Syringe barrel 18 is marked with graduations 19 and can have finger grips 2 to assist the user when the syringe is used to withdraw (suck-up) liquids. Attached to the proximal end of the syringe is a cap 9 connected by tether 22. Cap 22 can be used to seal in a liquid formulation within the syringe barrel. This may be necessary when paint formulations are pre-supplied by a manufacture as opposed to being formulated in the retail store. The cap can also provide a way for the paint formulation ingredients to be added to the proximal end of the syringe barrel. The cap can be manufactured using a material similar to that used for a septum and that will allow for an injection needle or other orifice from an automated device to penetrate the cap where the automated device can be programmed with a particular color and/or gloss level. Of course, the syringe assembly can also be filled in the conventional manner like a medical syringe by filling through the distal end with a formulated paint mixture or the individual components making up a paint formulation. An end cap 31 can be used to seal the distal opening of syringe 8.

The syringe barrel 18 is configured and manufactured to provide a secure fit inside rigid cup 10. Rigid cup 10 has an opening 32 at its distal end that receives and allows the distal end 11 of syringe 8 to protrude downwardly through an opening 33 in mid-platform 13, which supports and holds rigid cup 10 in position during filling of container 15. Rigid cup 10 and mid-platform 13 are configured to allow cup 10 to be removed with or without syringe 8 being loaded. Preferably, cup 10 is first removed from housing 1 empty and then syringe 8 is loaded inside the cup. An adaptor 12 can be attached to the distal end 11 of the syringe before the assembly is positioned back into housing 1 and secured to mid-platform 13. Adaptor 12 is configured to connect with valve 16 of can 15 and to provide a sealed fluid channel between the syringe and the interior of can 15. The sealed connection between the valve 16 and adaptor 12 must be sufficient to prevent leaks as the pressure in syringe barrel surpasses the initial pressure in can 15 during injection of the paint formulation into the can. Different size pressurized containers containing the initial liquid or paint formulation are accommodated within housing 1 by raising and lowering adjustable platform 17. A conventional aerosol can have a male valve or female valve as either will work in my system.

Once the paint formulation has been injected into can 15, the syringe assembly 8, preferably including adaptor 12, is removed from rigid cup 10 and disposed of for recycling. Because no paint formulation ever comes into contact with the rigid cup, the bushing, or the drive shaft there are no parts to clean before the next use of the filling system. All that is needed is anew syringe assembly.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

The invention claimed is:

1. A system for filling a container with a paint formulation comprising, in combination, a. a housing comprising a drive mechanism and an adjustable platform;

b. a rigid cup operatively located within the housing;

c. a drive shaft operatively connected to the drive mechanism; and d. a syringe having a barrel, a distal end and a proximal end and configured to fit inside of the rigid cup, where the syringe has a plunger at the proximal end configured to operably engage the drive shaft, wherein the plunger has an attached piston configured to slidably and sealably fit within the barrel such that proximal sliding movement of the plunger and piston can withdraw liquid from an external container into the barrel.

2. The system of claim 1 further comprising a bushing attached to the drive shaft and configured to connect to the plunger.

3. The system of claim 1 further comprising a pressurized container containing an initial paint formulation comprising a propellant and at least one of a clear non-pigmented base or clear pigmented base.

4. The system of claim 1 characterized in that the rigid cup is configured to be removable from the housing.

5. The system of claim 1 further comprising an adaptor configured to connect to the distal end of the syringe before the syringe is placed into the housing to provide a sealed fluid channel into an interior of an aerosol container positioned on the adjustable platform.

6. The system of claim 1 characterized in that the rigid cup has an opening to accept the distal end of the syringe.

7. The system of claim 1 where the syringe comprises an attached storage cap configured to seal the proximal end.

8. The system of claim 1 where the drive mechanism is selected from the group consisting of an electric motor, hand crank, and an hydraulic piston.

9. The system of claim 5 where the adaptor has a keyed connection that matches a connector in a valve opening in the pressurized container to allow transfer of liquid from the syringe barrel into the pressurized container.

10. The system of claim 1 where the syringe has finger grips and graduation marks on the side of the syringe barrel configured to allow a measured withdrawal of liquid from an external container.

* * * * *